US005937261A

United States Patent [19]

Shirakawa et al.

[11] Patent Number: 5,937,261

[45] Date of Patent: Aug. 10, 1999

[54] IMAGE RECORDING APPARATUS, AND SHEET CONVEYING METHOD THEREOF

[75] Inventors: Junji Shirakawa; Masayuki Ainoya; Minoru Seino, all of Ibaraki, Japan

[73] Assignee: Hitachi Koki Co., Ltd., Tokyo, Japan

[21] Appl. No.: 09/099,420

[22] Filed: Jun. 18, 1998

[30] Foreign Application Priority Data

Jun. 20, 1997 [JP] Japan ..... 9-164109

[51] Int. Cl.[6] ..... G03G 15/00; B65H 43/00; B65H 29/00

[52] U.S. Cl. ..... 399/401; 271/176; 271/186; 399/397

[58] Field of Search ..... 271/301, 65, 186, 271/176; 399/401, 397, 405

[56] References Cited

U.S. PATENT DOCUMENTS 5,317,377 5/1994 Rubscha et al. ..... 355/319

5,590,872 1/1997 Oominami et al. ..... 271/176

*Primary Examiner*—William Royer
*Assistant Examiner*—Greg Moldafsky
*Attorney, Agent, or Firm*—Sughrue, Mion, Zinn, Macpeak & Seas, PLLC

[57] ABSTRACT

An image recording apparatus and a method of using the image recording apparatus. The image recording apparatus has a sheet sending path connecting a sheet supply section, an image forming section, and a sheet discharge section. A pull-in path branches from the sheet sending path, and a return path branches from the pull-in path to define a branch point. A first pair and a second pair of conveying rollers are provided on the pull-in path on respective sides of the branch point.

The first pair and the second pair of conveying rollers are independently drivable in a forward direction and a reverse direction.

6 Claims, 9 Drawing Sheets

P1
P2
P3
P4
4
5
6
7
8
10
11
12
14
A
B

IMAGE RECORDING APPARATUS, AND SHEET CONVEYING METHOD THEREOF

BACKGROUND OF THE INVENTION

1. Field of the Invention

This invention relates to an image recording apparatus which is able to record images on both sides of a recording sheet, and to a sheet conveying method thereof.

2. Description of the Related Art

A conventional image recording apparatus which is able to record images on both sides of a recording sheet a(hereinafter referred to as "a both-side recording apparatus", when applicable) will be described with reference to the accompanying drawings.

In FIG. 4, reference characters 1*a*, 1*b* and 1*c* designate sheet supply sections which accommodates recording sheets; and 2, a photo-sensitive drum which starts rotating in response to a signal from a controller (not shown). As the photo-sensitive drum 2 starts rotating, the surface of the photo-sensitive drum 2 is uniformly charged by a corona charger (not shown). Further, an electro-static latent image is formed on the charged photo-sensitive drum 2 by an optical system (not shown). When reaching a developing unit, the latent image thus formed is developed as a toner image (visible image) on the photo-sensitive drum 2. The toner image thus formed by the conventional electro-photo process, is transferred onto a recording sheet by a transferring unit 3 which is delivered from the sheet supply section 1*a*, 1*b* or 1*c*. Further in FIG. 4, reference numeral 4 denotes a fixing unit which is adapted to fix the toner image which has been transferred onto the recording sheet; 10, a flap which is to control the direction of conveyance of a recording sheet; and 9, a sheet discharge section, namely, a sheet discharge tray on which a recording sheet on which an image has been formed and fixed is placed.

In the following description, for simplification in description, a sheet conveying path 12 connecting the sheet supply sections 1*a*, 1*b* and 1*c*, the image forming means 2, 3 and 4, and the discharge sheet tray 9 will be referred to as "a sheet sending path", when applicable. Reference numeral 11 designates a pull-in path, branching from the sheet sending path 12 downstream of the image forming means 2, 3 and 4 with respect to the direction of conveyance of a sheet. The pull-in path selectively pulls in a recording sheet which is delivered from the fixing unit 4 by switching the flap 10. Reference numeral 14 designates a return path which branches from the middle of the pull-in path 11, and its end meets the sheet sending path 12 upstream of the image forming means 2, 3 and 4 with respect to the direction of conveyance of a sheet. In the case where it is required to record images on both sides of a recording sheet, the sheet delivered from the fixing unit 4 is pulled in the pull-in path 11. The sheet thus pulled in is sent to the return path 14, so that the sheet on one side of which the image has been recorded is sent to the image forming means again, whereby the aimed both-side image recording operation is carried out. Furthermore, in FIG. 4, reference numerals 5 and 6 designate conveying rollers provided before and after the flap 10; 7, conveying rollers which is provided on the pull-in path 11 in such a manner that they can be turned in the forward -direction and in the reverse direction in a switching mode; and 13, a flap to send the sheet pulled in the pull-in path 11 to the return path 14 or to return it to the sheet sending path 12 again so as to be discharged into the discharge sheet tray 9.

In the case where, in the both-side recording apparatus shown in FIG. 4, the recording sheet is guided to the pull-in path 11 and turned over in the one-side print mode; in the case of a so called "one-side print, face-down sheet discharge mode", as shown in FIGS. 6A to 6D, the sheet P1 is pulled in with the conveying rollers 7 as shown in FIG. 6A, immediately after the rear end of the sheet P1 reaches the position A as shown in FIG. 6B, the direction of rotation of the conveying rollers 7 is switched, and as shown in FIG. 6C, the sheet P1 is returned to the sheet sending path 12 and then sent to the conveying (sheet-discharging) rollers 6. Next, when the front end of the sheet P1 is released from the conveying rollers 7, as shown in FIG. 6D, the direction of rotation of the conveying rollers 7 is switched again, so that a sheet P2 conveyed next is pulled in the pull-in path 11. Further, the sheet P2 is handled in the same way as the sheet P1.

In the case where, in the both-side printing mode, first a toner image is recorded on the first surface (front surface) of the sheet P1, and then the sheet P1 is turned over and returned through the return path 14 to the image forming means to record a toner image on the second surface (rear surface), and thereafter the sheet P1 is turned over and discharged into the sheet discharge tray 9; as shown in FIG. 7A, the sheet P1 only on the first surface (front surface) of which an image has-been recorded is pulled in with the conveying rollers 7, and as shown in FIG. 7B, immediately after the rear end of the sheet P1 reaches the position B, the conveying rollers 7 are turned in the reverse direction, so that as shown in FIG. 7C, the sheet P1 is sent to the return path 14 until, as shown in FIG. 7D, it is released from the conveying rollers 7.

Accordingly, in the both-side print mode, when compared with the one-side print mode, the time required for turning over the sheet; that is, the sum of the time for the conveying rollers 7 to pull in the sheet to be turned over and the time required for turning the conveying rollers 7 in the reverse direction to release the sheet, additionally needs the time which corresponds to the conveyance of the sheet over the distance which is about twice the distance between the positions A and B.

As shown in FIGS. 7C to 7F, in order that the following sheet P2 (on both sides of which images have been recorded) is pulled in the conveying rollers 7, and turned over so as to be discharged into the sheet discharge tray 9, the distance between the two sheets P1 and P2 should be long enough to avoid the difficulty that the sheet P2 is lapped over the preceding sheet P1 at the conveying rollers 7. That is, in the case of the both-side print mode, it is necessary to add at least the distance which is about twice the distance between the positions A and B to the sheet distance in the one-side print mode.

Accordingly, in the both-side print mode, the printing speed must be decreased.

In order to overcome the above-described difficulty, the apparatus may be modified as shown in FIG. 5: That is, a sheet turn-over device 19 is provided between the image recording apparatus 1 and the sheet discharge tray 9, and a sheet turn-over operation to send a sheet to the return path 14, and a sheet turn-over operation prior to the sending of a sheet to the sheet discharge tray 9 are separately carried out. However, the modification results in an increase in manufacturing cost, thus being not always advantageous.

SUMMARY OF THE INVENTION

Accordingly, an object of the invention is to provide an image recording apparatus, and its sheet conveying method in which the decrease in printing speed is prevented which attributes to the sheet turn-over operation in a both-side print mode.

The foregoing object of the invention has been achieved by the provision of an image recording apparatus including: a sheet sending path connecting a sheet supply section, image forming means for recording an image on a sheet which is conveyed, and a sheet discharge section adapted to accommodate the sheet on which an image has been recorded; a pull-in path which branches from the sheet sending path downstream of the-image forming means with respect to the direction of conveyance of the sheet; and a return path which branches from the middle of the pull-in path, and has the last end which meets the sheet sending path upstream of the image forming means with respect to the direction of conveyance of the sheet, in which a first pair of conveying rollers, and a second pair of conveying rollers are provided on the pull-in path which have drive means which operate independently of each other, and are driven in a forward direction and in a reverse direction in a switching mode with operation timing thereof, and the first pair of conveying rollers are provided downstream of the branch point of the pull-in path and the return path, while the second pair of conveying rollers are provided upstream of the branch point.

BRIEF DESCRIPTION OF THE DRAWINGS

Similar reference characters denote corresponding features consistently throughout the attached drawings. The preferred embodiments of this invention will be described in detail, with reference to the following figures, wherein.

DETAILED DESCRIPTION OF THE PREFERRED EMBODIMENTS

A preferred embodiment of the invention will be described with reference to the accompanying drawings.

Figure 1:
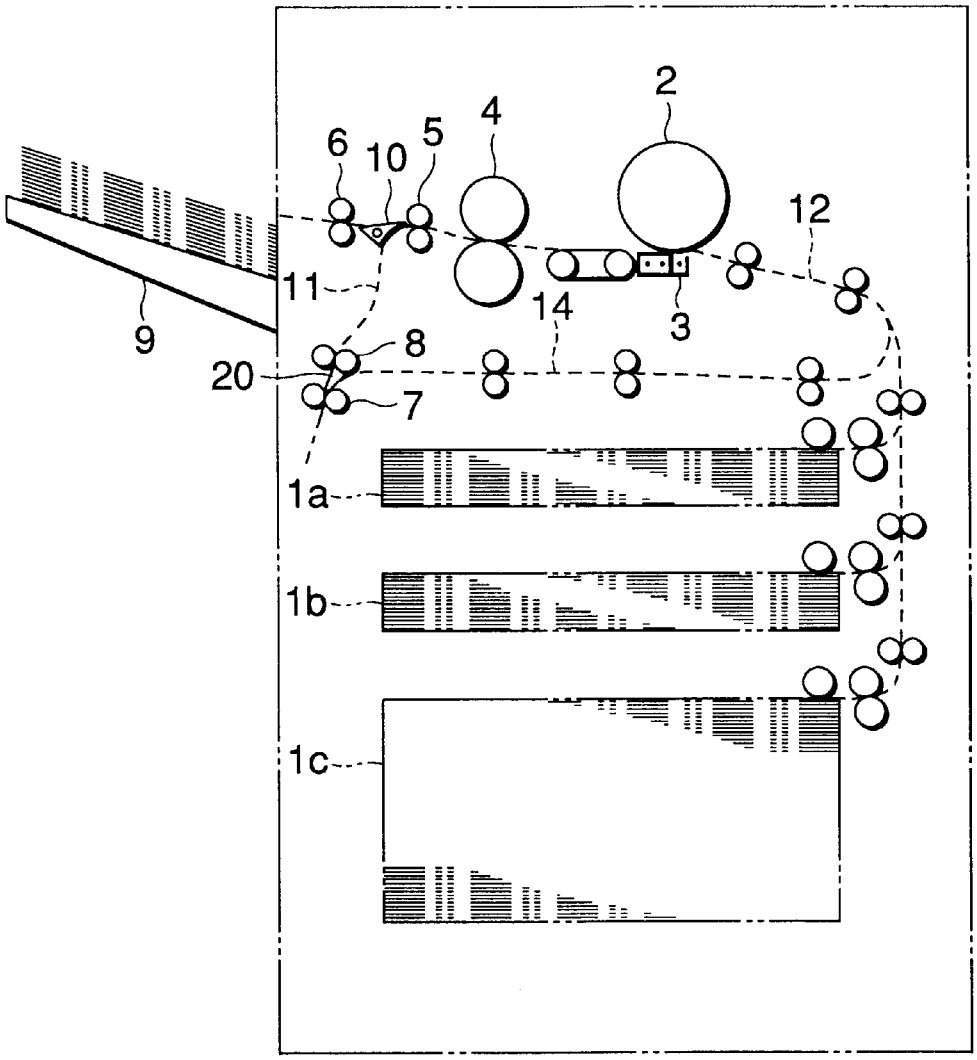
FIG. 1 is an explanatory diagram outlining the arrangement of an image recording apparatus, which constitutes an embodiment of the invention.

In FIG. 1, reference characters 1*a*, 1*b* and 1*c* designate sheet supply sections which accommodates recording sheets; and 2, a photo-sensitive drum which starts rotating in response to a signal from a controller (not shown). As the photo-sensitive drum 2 starts rotating, the surface of the photo-sensitive drum 2 is uniformly charged by a corona charger. Further, an electro-static latent image is formed on the charged photo-sensitive drum 2 by an optical system (not shown). When reaching a developing unit, the latent image thus formed is developed as a toner image (visible image) on the photo-sensitive drum 2. The toner image thus formed by the conventional electro-photo process is transferred by a transferring unit 3 onto a recording sheet which is delivered from the sheet supply section 1*a*, 1*b* or 1*c*. Further in FIG. 1, reference numeral 4 denotes a fixing unit which is adapted to fix the toner image which has been transferred onto the recording sheet; 10, a flap which is to control the direction of conveyance of a recording sheet; and 9, a sheet discharge section, namely, a sheet discharge tray on which a recording sheet on which an image has been formed and fixed is placed.

Reference numeral 12 designates a sheet sending path, or a sheet conveying path connecting the sheet supply sections 1*a*, 1*b* and 1*c*, the image forming means 2, 3 and 4, and the sheet discharge tray 9.

Reference numeral 11 designates a pull-in path, which branches from the sheet sending path 12 downstream of the image forming means 2, 3 and 4 with respect to the direction of conveyance of a sheet. The pull-in path 11 selectively pulls in the sheet which is sent out of the fixing unit 4 by switching the flap 10.

Reference numeral 14 designates a return path, which branches from the middle of the pull-in path. The last end of the return path 14 meets the sheet sending path 12 upstream of the image forming means 2, 3 and 4 with respect to the direction of conveyance of a sheet.

In the case where it is required to record images on both sides of a recording sheet, the sheet sent out of the fixing unit 4 is pulled in the pull-in path 11, and then sent to the return path 14, so that the sheet on one side of which an image has been recorded is sent into the image forming means again; that is, the both-side image recording operation is carried out. In FIG. 1, reference numerals 5 and 6 designate conveying rollers provided before and after the flap 10; 7, and 8, respectively, a pair of conveying rollers which are provided on the pull-in path 11 and are turned in the forward direction and in the reverse direction in a switching mode (described later in detail); and 20, a guide member which guides the sheet which has been pulled in the pull-in path 11 to the return path 14, or to return it to the sheet sending path 12.

Figure 2A:
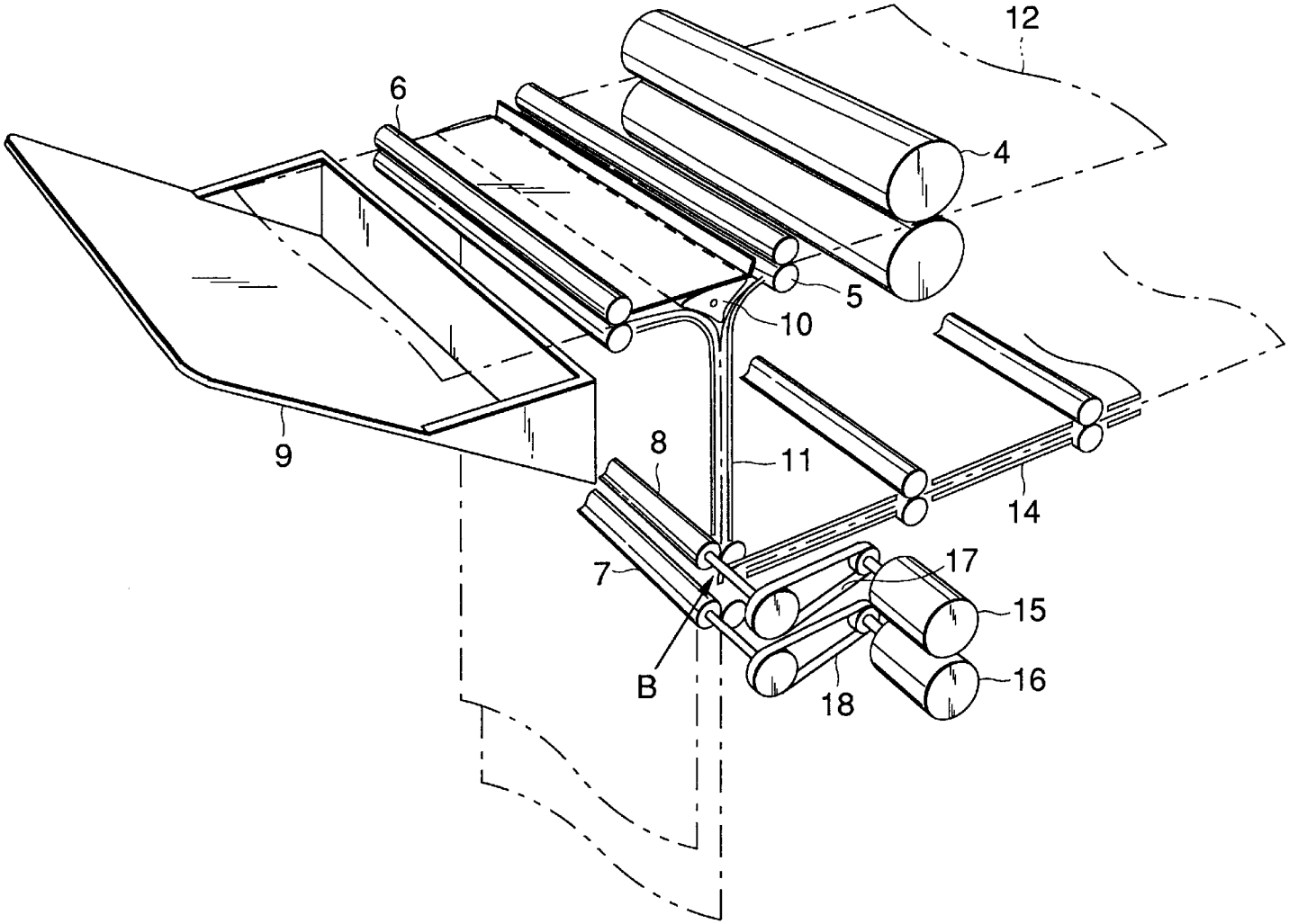
FIG. 2A is a perspective view showing essential parts of a sheet turn-over mechanism in the image recording apparatus of the invention.

The arrangement of the conveying rollers 7 and 8 will be described with reference to FIGS. 2A and 2B.

The first conveying rollers 7 are provided downstream of a branch point B of the pull-in path 11 and the return path 14, while the second conveying rollers 8 are provided upstream of the branch point B. The first conveying rollers 7 are driven through a timing belt 18 by an electric motor 16, while the second conveying rollers 8 are driven through a timing belt 17 by an electric motor 15. A rotation shaft 71*a* of a roller 7*a* which is one of the first conveying rollers 7 is provided so as to coincide with a rotation shaft 20*b* of the guide member 20, as shown in FIG. 2B.

Figure 2B:
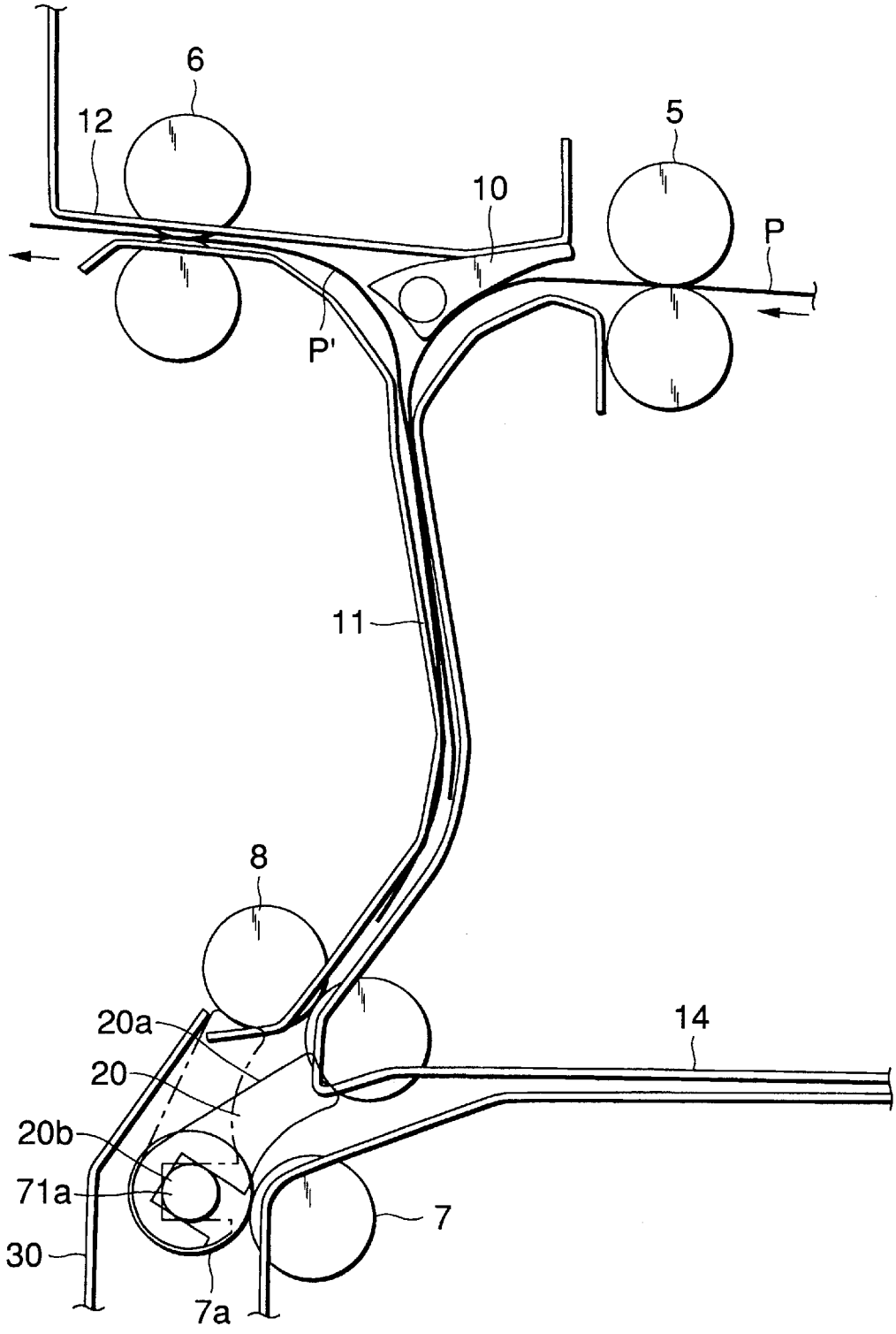
FIG. 2B is a side sectional view showing essential parts of a sheet turn-over mechanism in the image recording apparatus of the invention.

In the above structure, in a case that the sheet is turned over and discharged, the sheet P conveyed by the conveying rollers 5 is guided to the pull-in path 11 through the flap 10, passes through the second conveying rollers 8 and a back surface 20*a* of the guide member 20 (in this case, the guide member 20 exists in a position shown in a solid line of FIG. 2B), and is then sent toward a sheet guide 30. When a sheet sensor (not shown) provided in the pull-in path 11 detects a rear end of the sheet P, the second conveying rollers 8 are controlled so as to halt the sheet at a predetermined position. After the sheet is halted, the second conveying rollers 8 are immediately turned in the reverse direction, so as to send the sheet toward the conveying rollers 6, as shown in the sheet P' of FIG. 2B.

In the case where the both-side printing operation is carried out, the behavior of the first and second conveying rollers, and the movement of the sheet accompanying the behavior will be described with reference FIGS. 3A to 3F. In the both-side printing operation, the sheet on one side of which images have been recorded and the sheet on both sides of which images have been recorded are alternatively conveyed. In FIGS. 3A to 3F, reference marks P1 and P3 designate the sheets on one side of which images have been recorded; P2 and P4, the sheets on both side of which images have been recorded.

Figures 3A, 3B, 3C, 3D, 3E, 3F:
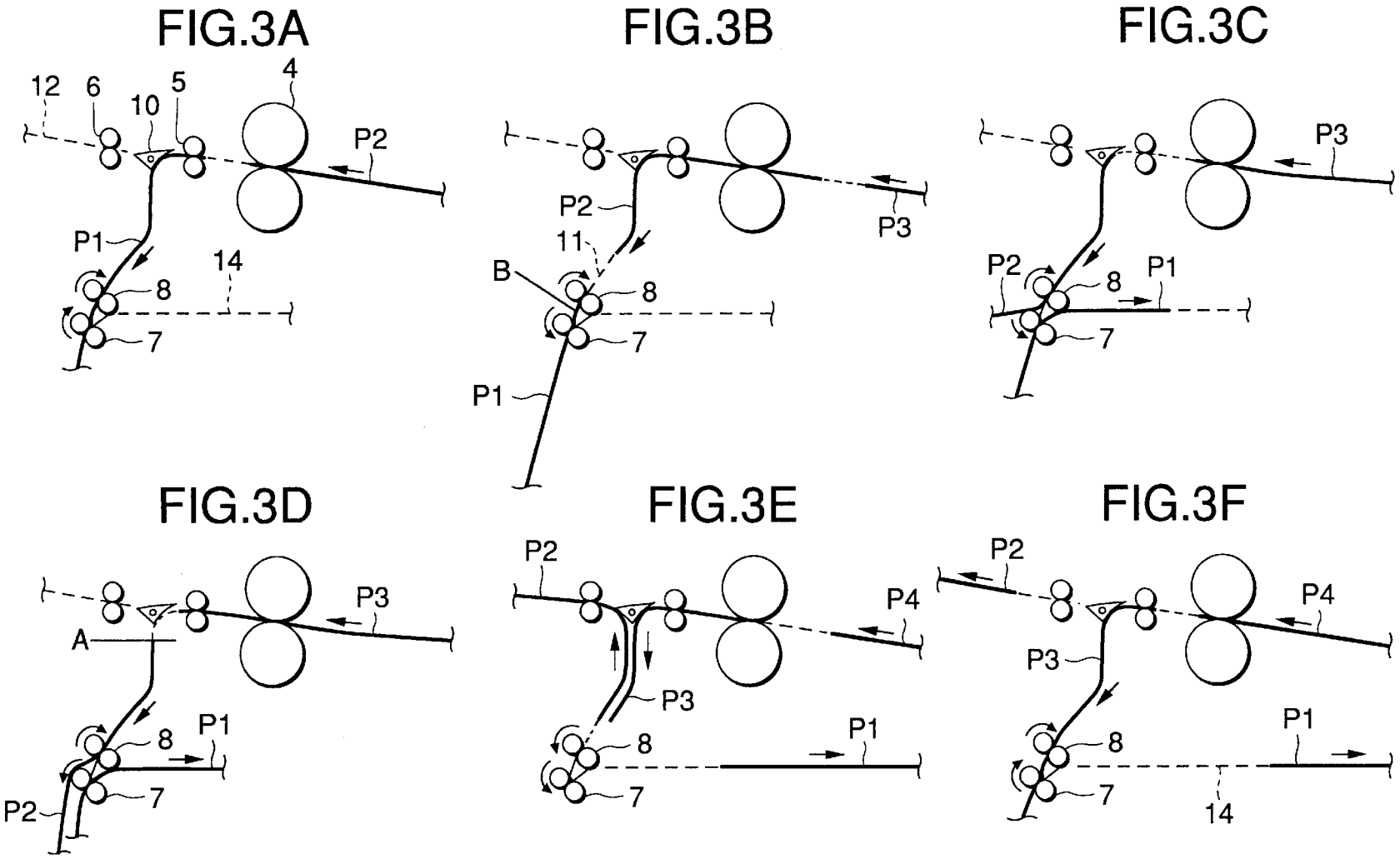
FIGS. 3A to 3F are explanatory diagrams for a description of a sheet turn-over operation in the apparatus of the invention.
Figure 4:
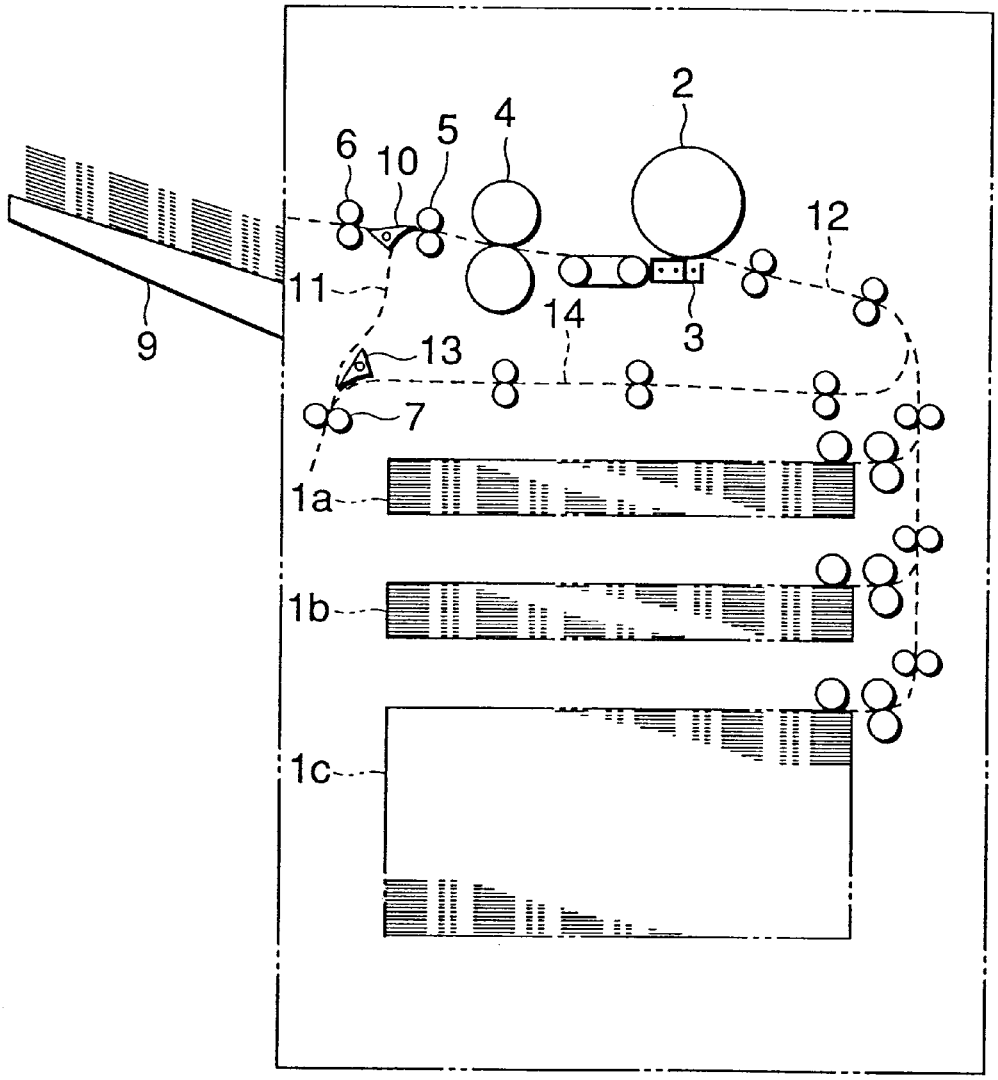
FIG.4 PRIOR ART
FIG. 4 is an explanatory diagram outlining the arrangement of an example of a conventional image recording apparatus.
Figure 5:
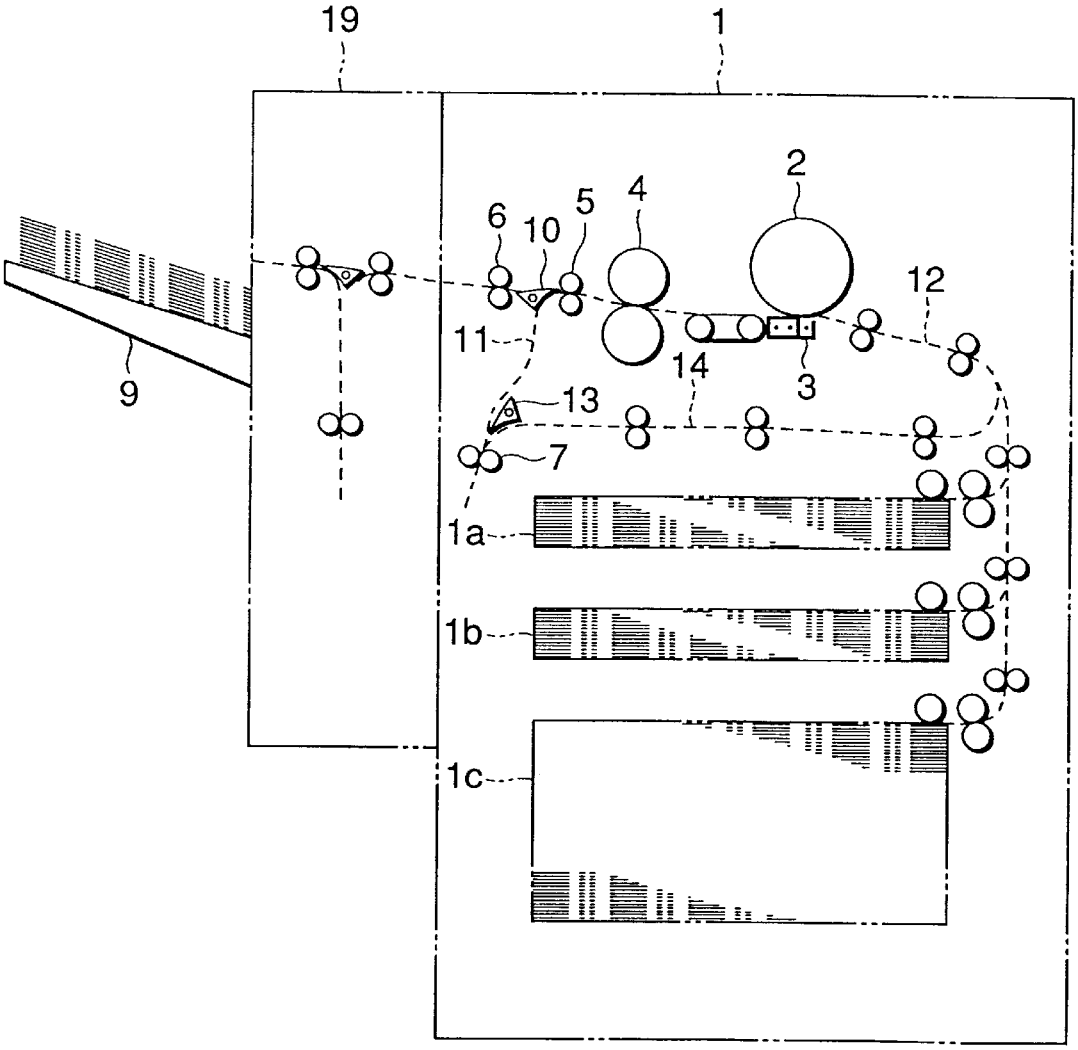
FIG.5 PRIOR ART
FIG. 5 is an explanatory diagram outlining the arrangement of another example of the conventional image recording apparatus.
Figure 6A:
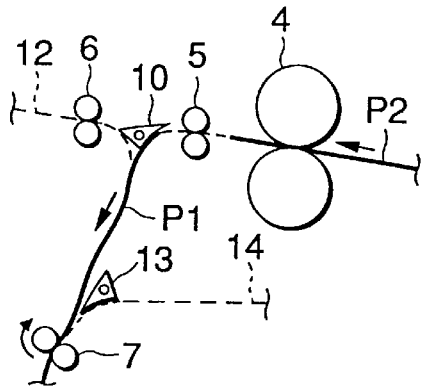
FIG.6A PRIOR ART
FIGS. 6A to 6D are explanatory diagrams for a description of a sheet turn-over operation in the conventional image recording apparatus.
Figure 6B:
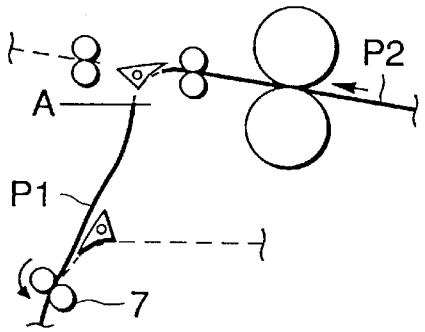
FIG.6B PRIOR ART
Figure 6C:
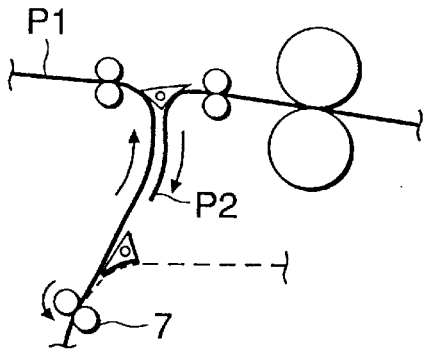
FIG.6C PRIOR ART
Figure 6D:
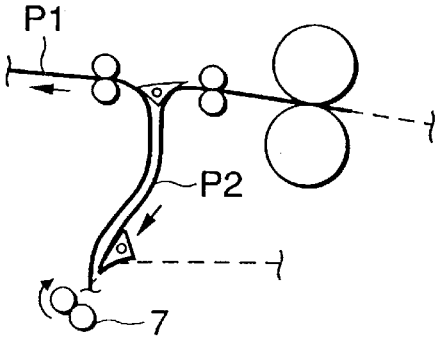
FIG.6D PRIOR ART
Figure 7A:
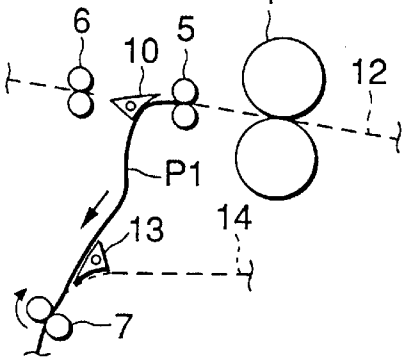
FIG.7A PRIOR ART
FIGS. 7A to 7F are explanatory diagrams for a description of a sheet turn-over operation in the conventional image recording apparatus.
Figure 7B:
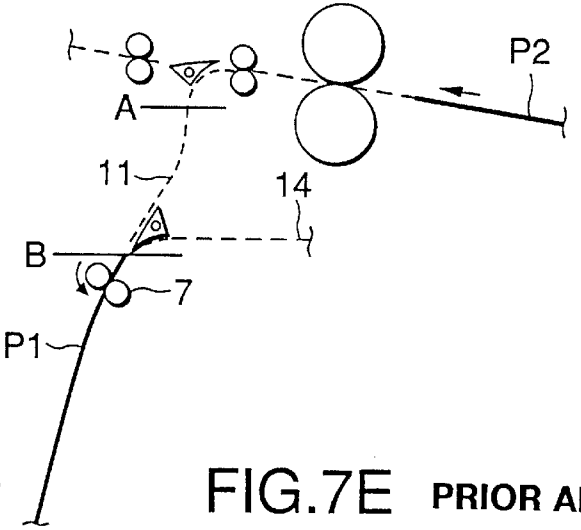
FIG.7B PRIOR ART
Figure 7C:
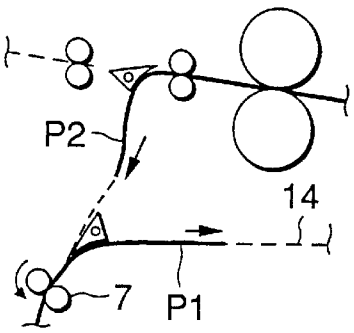
FIG.7C PRIOR ART
Figure 7D:
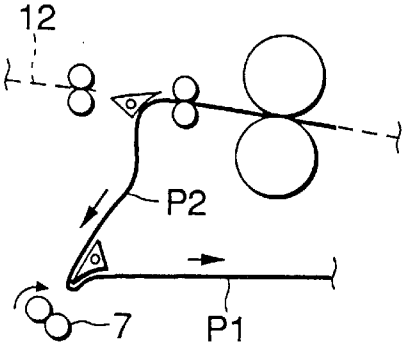
FIG.7D PRIOR ART
Figure 7E:
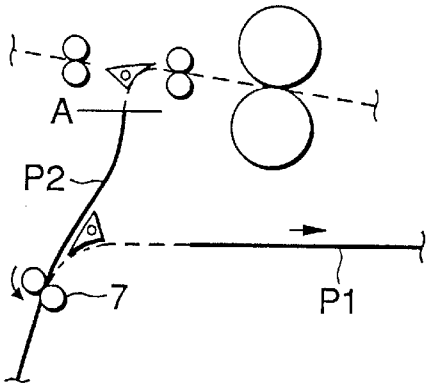
FIG.7E PRIOR ART
Figure 7F:
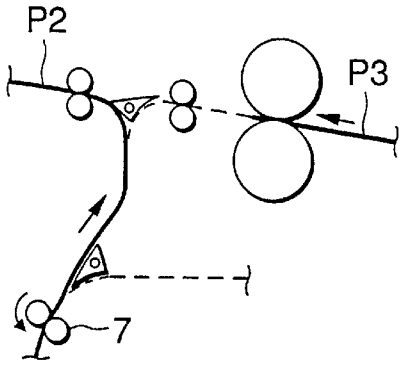
FIG.7F PRIOR ART

As shown in FIG. 3A, the sheet P1 on the first surface (front surface) of which a toner image has been recorded is guided to the pull-in path 11. In this case, the first and second conveying rollers 7 and 8 are turned in the same direction to pull in the sheet P1. As shown in FIG. 3B, the rear end of the sheet P1 passes through the second conveying rollers 8. Further, immediately after the rear end of the sheet P1 reaches the position B, the first conveying rollers 7 are turned in the reverse direction to send the sheet P1 to the return path 14 as shown in FIG. 3C. In this time, the second conveying rollers 8 are not turned in the reverse direction; that is, they are kept turned in the forward direction.

Next, as shown in FIG. 3D, the sheet P2 on both sides of which images have been recorded are pulled in the second conveying rollers 8 after the sheet P1. In this case, the first convey rollers 7 keeps sending the sheet P1 to the return path 14. Therefore, the sheet pulled in the second conveying rollers 8 is not pulled in the first conveying rollers 7, but moved on the left of the conveying rollers 7. When the rear end of the sheet P2 reaches the position A, the second conveying rollers 8 are turned in the reverse direction, so that, as shown in FIG. 3E the sheet P2 is sent through the sheet sending path 12 to the sheet discharge rollers 6. When the front end of the sheet P1 sent to the return path 14 is released from the first conveying rollers 7, the direction of rotation of the first conveying rollers 7 is changed; that is, the rollers 7 are turned in the forward direction, and when the front end of the sheet P2 sent to the sheet discharge rollers 6 is released from the second conveying rollers 8, the direction of rotation of the second conveying rollers 8 is changed; that is, the rollers 8 are turned in the forward direction, as shown in FIG. 3F.

Figure 8A:
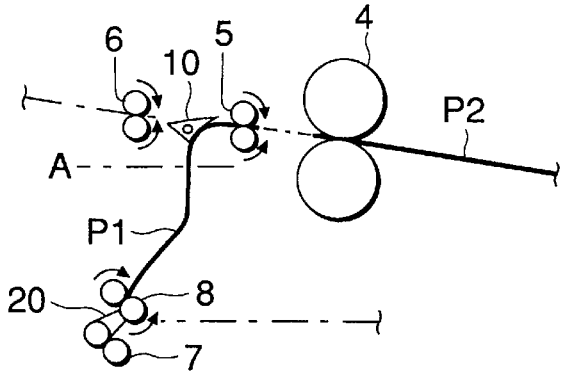
FIGS. 8A to 8D are explanatory diagrams for a description of an one-side print mode in the apparatus of the invention.
Figure 8B:
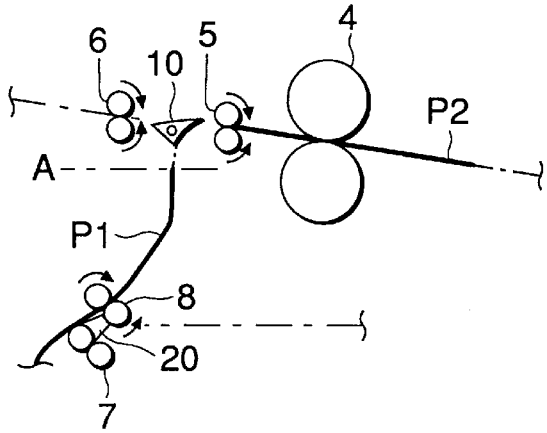
Figure 8C:
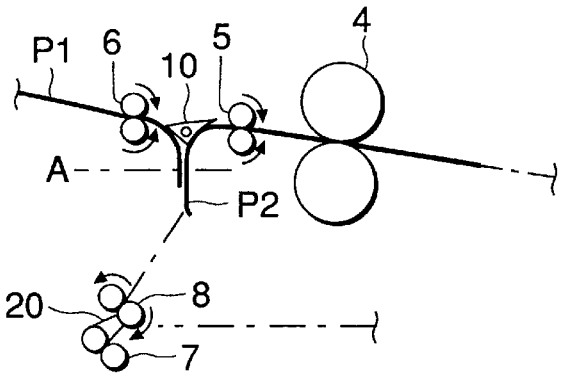
Figure 8D:
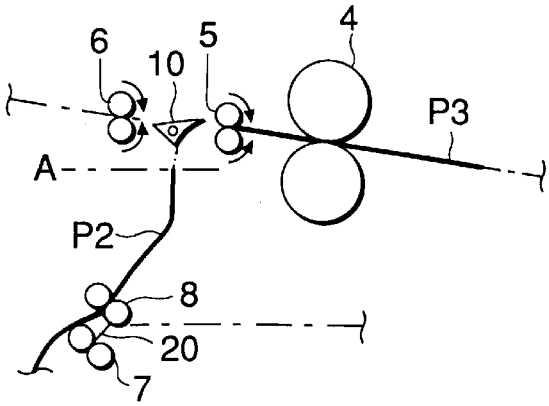

Although the above apparatus is devised for a both-side print mode, this apparatus is certainly applied to an one-side print mode, as shown in FIGS. 8A to 8D. In FIGS. 8A to 8D, reference marks P1 to P3 designate the sheets on one side of which images have been recorded. In FIG. 8A, the sheet P1 guided to the pull-in path 11 is conveyed by the second conveying rollers 8. The sheet P1 conveyed by the rollers 8 is guided to the outside of the first conveying rollers 7 by means of the guide member 20. When the rear end of the sheet P1 reaches the position A, as shown in FIG. 8B, the second conveying rollers 8 are turned in the reverse direction, and further the conveying rollers 6 and 8 are turned at high speed so as to discharge the sheet P1, as shown in FIG. 8C. When the sheet P1 reaches a predetermined position, rotary direction and rotary speed of the rollers 8 is returned in a former state, and then the following sheet P2 is guided (FIG. 8D). In the one-side print mode, the processes shown in FIGS. 8A to 8D are repeated.

As is apparent from the above description, according to the invention an image recording apparatus, and its sheet conveying method can be provided in which the decrease in printing speed is prevented which attributes to the sheet turn-over operation in a both-side print mode.

What is claimed is:

1. An image recording apparatus comprising:

a sheet sending path connecting a sheet supply section, image forming means for recording an image on a sheet which is conveyed, and a sheet discharge section to accommodate said sheet on which an image has been recorded;

a pull-in path branching from said sheet sending path downstream of said image forming means with respect to the direction of conveyance of said sheet;

a return path branching from said pull-in path to define a branch point, and connecting to said sheet sending path upstream of said image forming means with respect to the direction of conveyance of said sheet;

a first pair of conveying rollers provided on said pull-in path on one side of said branch point, and a second pair of conveying rollers provided on said pull-in path on another side of said branch point;

wherein said first pair and said second pair of conveying rollers are independently drivable in a forward direction and a reverse direction.

2. The image recording apparatus according to claim 1, wherein a first sheet is conveyable from said pull-in path to said return path by said first pair of conveying rollers, and simultaneously, a second sheet is conveyable outside of said first pair of conveying rollers by said second pair of conveying rollers.

3. A sheet conveying method for an image recording apparatus including (1) a sheet sending path (2) a pull-in path branching from said sheet sending path (3) a return path branching from said pull-in path to define a branch point (4) a first pair of conveying rollers provided on said pull-in path on one side of said branch point, and (5) a second pair of conveying rollers provided on said pull-in path on another side of said branch point, said method comprising the steps of:

directing a first sheet conveyed along said sheet sending path to said pull-in path;

pulling said first sheet along said pull-in path via said first pair and said second pair of conveying rollers rotating in a forward direction;

sending said first sheet to said return path via said first pair of conveying rollers rotating in a reverse direction, after a trailing end of said first sheet passes through said second pair of conveying rollers;

directing a second sheet conveyed along said sheet sending path to said pull-in path;

pulling said second sheet long said pull-in path via said second pair of conveying rollers rotating in said forward direction, during said sending step; and returning said second sheet to said sheet sending path via said second pair of conveying rollers rotating in a reverse direction, after a trailing end of said second sheet is pulled from said said sheet sending path.

4. The sheet conveying method according to claim 3, wherein the step of pulling said second sheet includes passing said second sheet to an outside of said first pair of conveying rollers.

5. The sheet conveying method according to claim 3, further comprising the steps of:

directing a third sheet conveyed along said sheet sending path to said pull-in path; and pulling said third sheet along said pull-in path via said first pair and said second pair of conveying rollers rotating in said forward direction, after (1) said first sheet is released from said first pair of conveying rollers, and (2) said second sheet is released from said second pair of conveying rollers.

6. An image recording apparatus comprising:

a sheet sending path;

a pull-in path branching from said sheet sending path;

a return path branching from said pull-in path, thereby defining a branch point; and a first pair and a second pair of conveying rollers provided along said pull-in path, each of said first pair and said second pair of conveying rollers being located on a respective side of said branch point;

wherein said first pair and said second pair of conveying rollers are independently drivable in a forward direction and a reverse direction.

* * * * *